US006263637B1

(12) United States Patent
Spene et al.

(10) Patent No.: US 6,263,637 B1
(45) Date of Patent: Jul. 24, 2001

(54) PREFABRICATED EMERGENCY SHELTER

(76) Inventors: Chris A. Spene, 8158 Racine Ter., Austin, TX (US) 78717-5344; Dean W. Morgan, 419 Lake Point Dr., Marble Falls, TX (US) 78654

( * ) Notice: Subject to any disclaimer, the term of this patent is extended or adjusted under 35 U.S.C. 154(b) by 0 days.

(21) Appl. No.: 09/430,121

(22) Filed: Oct. 29, 1999

Related U.S. Application Data

(62) Division of application No. 09/132,047, filed on Aug. 11, 1998.

(51) Int. Cl.[7] ..... E04H 9/14

(52) U.S. Cl. ..... 52/745.02; 52/742.14; 52/745.2; 52/747.1; 52/169.6

(58) Field of Search ..... 52/79.1, 169.1, 52/169.6, 169.7, 19, 745.02, 742.14, 745.2, 747.1

(56) References Cited

U.S. PATENT DOCUMENTS

| | | | | |
|---|---|---|---|---|
| 3,745,738 | * | 7/1973 | Singer | 52/169.6 X |
| 4,539,780 | * | 9/1985 | Rice | 52/169.6 |
| 4,615,158 | | 10/1986 | Thornton | 52/169.6 |
| 4,642,952 | * | 2/1987 | Prandin | 52/169.6 |
| 4,805,360 | * | 2/1989 | Kuehnl | 52/169.1 |
| 4,955,166 | * | 9/1990 | Qualline | 52/169.6 |
| 5,022,202 | * | 6/1991 | Johnson, jr. | 52/79.1 X |
| 5,481,837 | * | 1/1996 | Minks | 52/169.6 |
| 5,749,181 | | 5/1998 | Bauman | 52/169.6 |
| 5,930,961 | * | 8/1999 | Beaudet | 52/169.6 |
| 5,979,128 | * | 1/1999 | Parsons | 52/79.1 X |

* cited by examiner

*Primary Examiner*—Beth A. Stephan
*Assistant Examiner*—Brian E. Glessner
(74) *Attorney, Agent, or Firm*—Rick B Yeager

(57) ABSTRACT

A method of installation of an emergency shelter to be used under the floor of a residential or commercial structure. In the preferred embodiment, a prefabricated acrylic shelter is sized to accommodate at least one individual in a crouching or sitting position. In the preferred embodiment, the shelter is placed prior to the pouring of a slab foundation. In an alternate embodiment, the shelter is placed prior to building the floor in a pier and beam foundation.

8 Claims, 9 Drawing Sheets

PREFABRICATED EMERGENCY SHELTER

This application is a divisional application for application No. 09/132,047 filed Aug. 11, 1998.

FIELD OF INVENTION

This invention relates to a method of installation of prefabricated storm shelters.

BACKGROUND

Underground storm shelters have proven to be effective shelters for tornadoes in many parts of the country. Buried or partially buried storm shelters have been used for many years. The difficulties of incorporating buried storm shelters in residential constructions and neighborhoods include the expense, the lack of space associated with the standard lot, and the presence of shallow bedrock in many areas. The fabrication of traditional storm shelters is also relatively expensive.

The recommended procedure for tornado alerts in many parts of the country is for the residents to move to the center part of their house, such as an interior bathroom or closet. While this strategy is generally effective, there are cases of extremely high winds where residents are not safe in any part of the house and where the only practical effective shelter is one that is below the foundation of the home or buried in the vicinity of the home.

The most common material of construction of existing storm shelters is concrete, which nay either be prefabricated in one or more sections for site assembly; or poured in place structures. Although the concrete shelters are strong, there are several disadvantages to that material including difficulty and expense of installation, weight, long-term water resistance, and interior moisture condensation.

An object of the current invention is to provide a storm shelter to be installed below the floor level of a home for use in an emergency. Another object of the invention is to provide a shelter that can be installed without limitations of lot size or easement restrictions.

It is a further object of the present invention to provide a shelter that requires limited excavation.

It is a further object of the present invention to provide such a shelter in a relatively inexpensive prefabricated form.

It is a further object of the present invention to provide a material of construction which is water resistant, which will minimize condensation on the interior of the shelter, and which will provide a shelter that is relatively impervious to water seepage from the outside.

It is a further object of the present invention to provide a shelter with interior surfaces which are smooth, sturdy, corrosion-free, and pleasant.

It is a still further object of the invention to provide an underground emergency shelter system that accomplishes all or some of the above objects in combination.

It is an object of the present invention to provide a prefabricated shelter of a material which is lighter and easier to install than precast concrete. It is a further object of the present invention to provide a shelter which can be built into new construction in a manner which permits entry from the interior of the home. In the current invention it is desirable to place the unit below the floor lever for maximum safety and security.

It is an object of the preferred embodiment of the invention to provide a lightweight underground emergency shelter system and may be anchored by a house foundation without requiring a separate and elaborate anchoring apparatus.

An object of the present invention is to provide a prefabricated shelter which can be constructed with materials such as acrylic which is used in conventional tubs and spas, and which can be fabricated by vendors such as tub and spa vendors. It is a further object of the present invention to provide prefabricated units which can be handled without special equipment such as cranes.

An object of the present invention is to provide a pleasant interior surface in a single unit without requiring an exterior support frame.

One object of the present invention is to provide a smaller and more affordable emergency shelter which does not require elaborate anchoring.

U.S. Pat. No. 4,955,166 for a "Tornado underground shelter" issued on Sep. 11, 1990 to Steve M. Qualline and Louis R. Dunnam describes a large, generally spherical tornado shelter with a seat member is attached to the sidewall and floor which forms a structural member that strengthens the globe. The patent describes disadvantages of concrete structures shrinkage, cracking, and becoming saturated with moisture such that the interior is unsuitable for habitation or storage. The shelter provides standing headroom for its occupants. The '166 patent references a second embodiment of incorporating the large spherical structure into the floor of a home with the entrance above the floor level of the home. The patent also references placing the structure under a patio with the stairway extending at least three steps above the top surface of the patio, thereby precluding someone inadvertently falling through the open door thereof. An object of the present invention is to provide a relatively inexpensive prefabricated structure of more practical size that can be incorporated more readily into conventional home designs without increasing the foundation size of home.

SUMMARY OF THE INVENTION

In the preferred embodiment of this invention, a prefabricated storm shelter with a top entrance of approximately 28 inches square is installed below the foundation or floor of a residence. Fabrication of the unit is preferably in a top section and a bottom section with the unit sealed along its side surfaces to prevent moisture intrusion. The unit is typically composed of a material such as acrylic upon a reinforced fiberglass to provide structural integrity and a relatively pleasant interior finish. The shelter is designed to be placed so that the entrance way is at the floor level of first floor of a residential or commercial structure having a concrete slab foundation. Alternately, the unit may be placed so that the hatch is at the floor level of a pier and beam foundation.

BRIEF DESCRIPTION OF DRAWINGS

These and other objects and advantages of the present invention are set forth below and further made clear by reference to the drawings, wherein.

DESCRIPTION OF THE PREFERRED EMBODIMENT

The preferred embodiment of the shelter is designed for installation below a concrete slab foundation of a residential structure.

Figure 1:
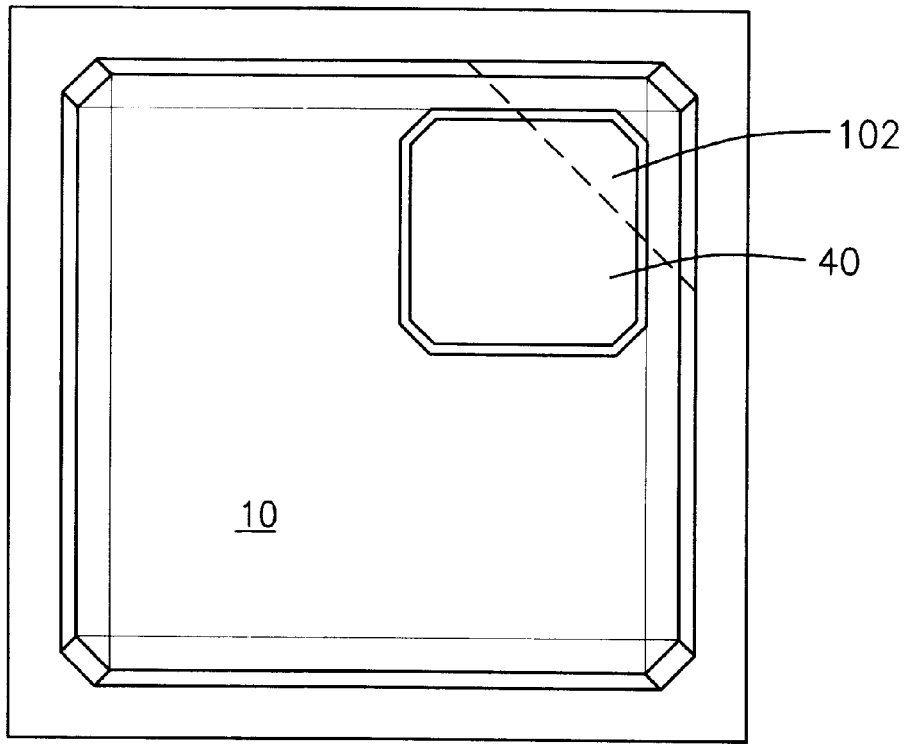
FIG. 1 is a top view of the shelter.
Figure 2A:
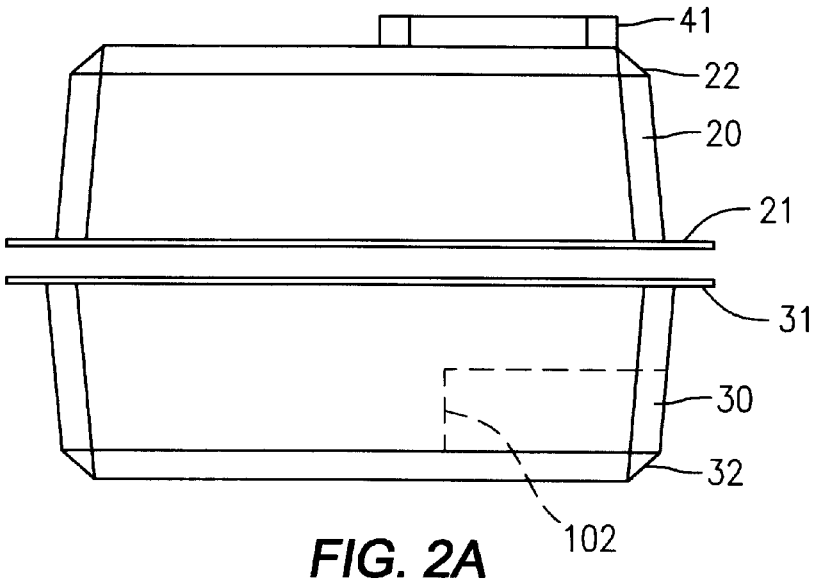
FIG. 2A is an exploded side view of the shelter.

Referring now to FIG. 1 which is a top view of the preferred embodiment, and to FIG. 2, which is a side view of the preferred embodiment, the shelter 10 is approximately 6 feet in width and 6 feet in length and has a height of at least 36 inches. Greater lengths and widths may be used in cases where additional space is required. Greater heights may by used, and a height of 42 inches is an approximate height to permit a relatively convenient crouching or sitting for a temporary stay during an event such as a tornado or thunderstorm. The shelter is preferably composed of a top section 20 and a bottom section 30. The top section has a lip 21 which is fastened to the bottom section lip 31 during assembly to create a single unit. The top section contains a hatch 40 which is typically located near a side wall so that a prefabricated step 102 may be used to assist a person in entering and exiting the shelter. The opening of the hatch is preferably at least 28 inches by 28 inches. The hatch includes a riser section 41 that is typically about 5" above the top of the upper section. This height allows room for a layer of sand and the thickness of a typical concrete slab.

The unit is preferably assembled at the factory or dealer, but it can also be assembled on site as described in the alternate embodiment.

Figure 2B:
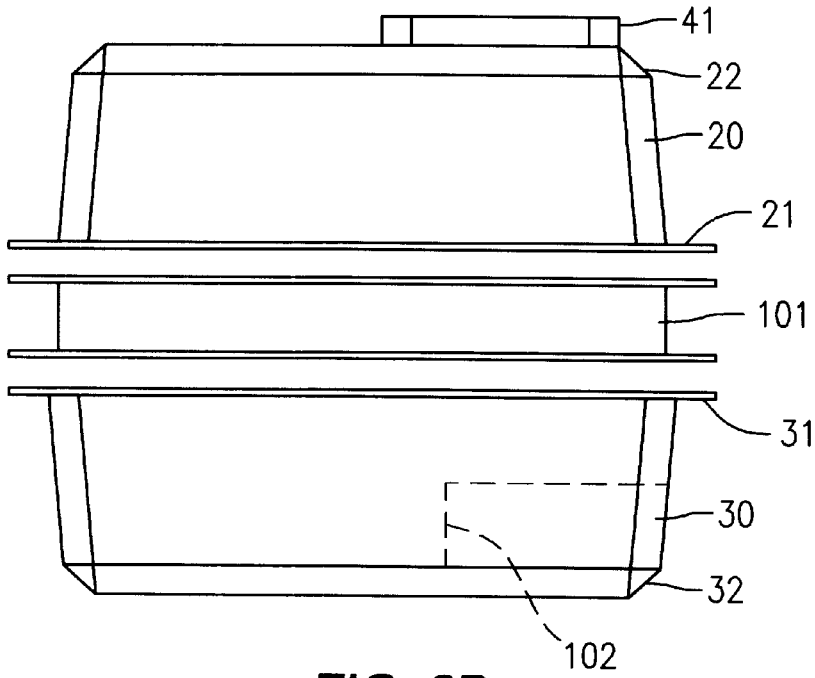
FIG. 2B is an exploded side view of the shelter with a vertical extension section.
Figure 3:
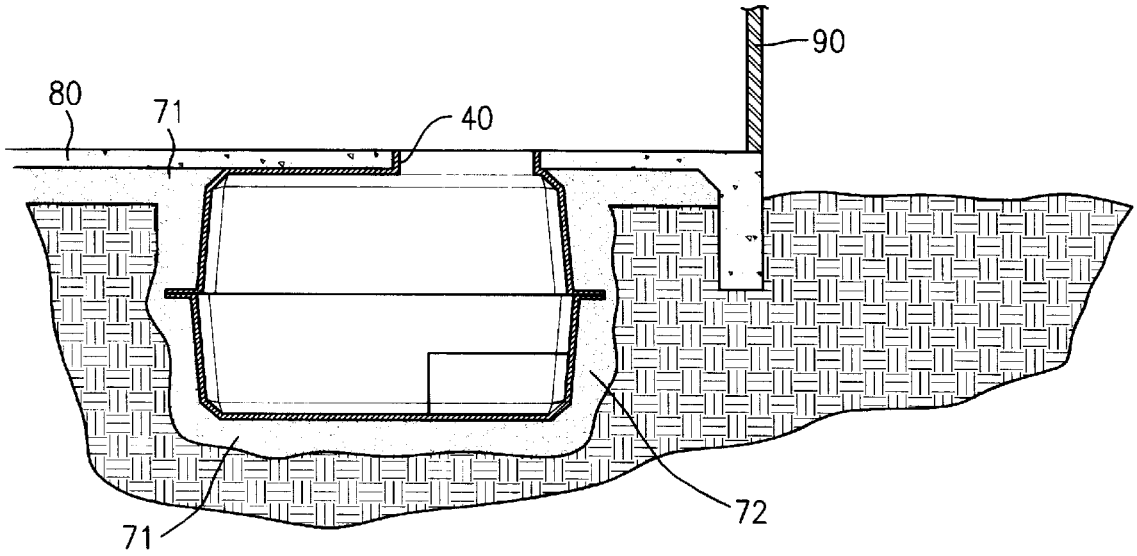
FIG. 3 is a detailed side view of the installation of the shelter in a typical slab foundation.

Referring now to FIG. 3, the unit is preferably installed so the top of the hatch is located at the floor level of a slab. The floor 80 is poured level around the hatch 40. This hatch is typically located in a closet near an exterior wall 90. The reason for locating the hatch in a closet is for cosmetic purposes. One reason for locating the hatchway near an exterior wall is the ability to vent the unit through an exterior wall. An additional benefit to placing the unit near an exterior wall is to permit easier reference points for placing and aligning the unit within a foundation. Referring now to FIG. 2 which is a cross section of the preferred embodiment, the shelter is preferably fabricated with a vacuum molding process similar to the process for fabricating tubs and spas. The bottom section is preferably fabricated in a female mold where a hot acrylic sheet with a thickness of approximately ⅛" is placed over the mold, and a vacuum drawn on the mold to form the hot sheet to conform to the bottom section mold. The bottom edges are beveled 32 to avoid sharp corners and edges in order to support this vacuum forming process, to avoid stress points on the completed section, and to provide improved comfort within the shelter. Alternate resin materials may be used including ABS, PVC, polyethylene, and fiberglass reinforced gel coat. The top section is preferably fabricated in a male mold where a hot acrylic sheet is placed over the mold, and a vacuum drawn on the mold to form the hot sheet to conform to the top section mold. The top edges are beveled 22 to avoid sharp corners and edges in order to support this vacuum forming process and to avoid stress points on the completed section. Both the top section and the bottom section can be fabricated in either a male mold or a female mold.

The vacuum forming process produces thin shells of the upper and lower shelter sections. These shells are reinforced by applying a fiberglass resin material to a thickness of about ¼", with additional material provided at stress points. The preferred method of applying the fiberglass reinforcement is to spray a cut fiberglass/resin composition to the back side of the shells. The preferred composition is 18% glass, 1.5% catalyst, and 80.5% resin. Structural coring can be placed within the laminated fiberglass to add structural strength.

Figure 5:
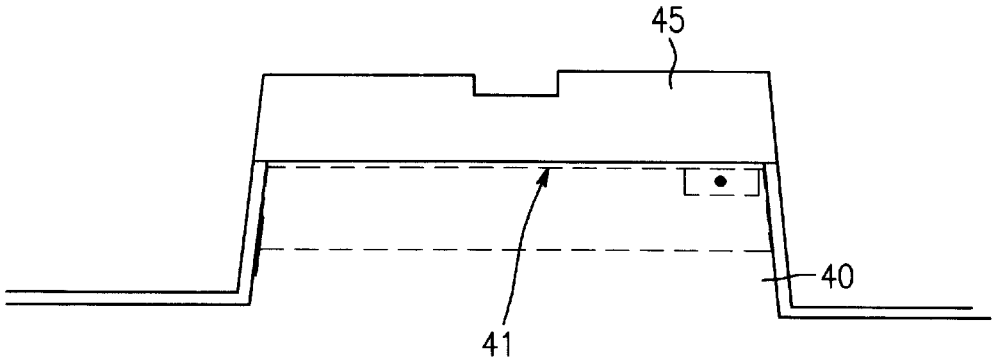
FIG. 5 is a side view of illustrating the removal of a lid from the molded upper section.

Referring now to FIG. 5 which is a side view of the top section showing the molded hatchway area, the top hatch is formed as a closed section approximately seven inches above the top of the upper section. In order to form the hatchway 40, the hatched top is cut approximately two inches below this extension. Hinges 43 are used to mount this cut away section 45 so that it opens by swinging downward into the shelter. In the preferred embodiment, a step is formed on the bottom shell, and the hinges are mounted on the opposite side of the hatch from where the step is located so that the hatch can be fully opened without obstruction. There are several advantages to and inward opening door including resistance to suction and the ability to open the door if debris falls over the door opening.

Figure 6:
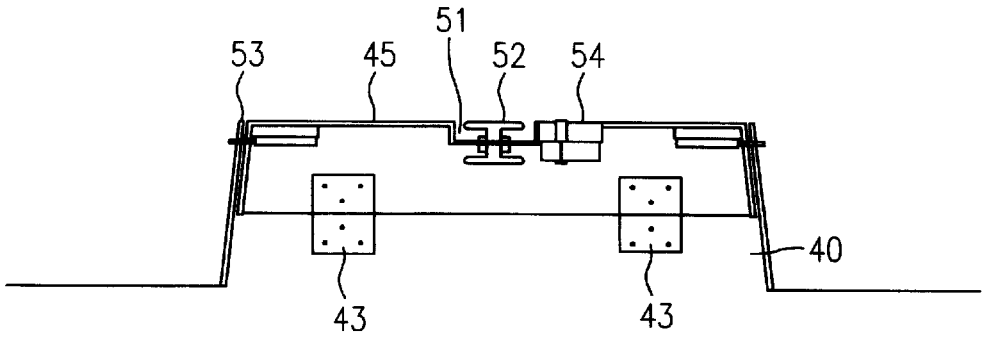
FIG. 6 is a side view of the shelter lid

Referring now to FIG. 6 which is a side view of the top section showing the installed hatch lid 45, the lid is mounted with two hinges 43. The lid is latched by spring loaded latch bolts 53 which extend into recesses in the hatch opening. The lid is recessed 51 for a diameter of about 4–5" diameter and 1 to 1.5 inch deep for a handle 52, which is preferably a garage door-type mechanism. The spring loaded latch bolts 53 are moved into a retracted position when the handle is turned, thereby permitting the hatch to be opened. A lock 54 is typically provided to restrict entry into the shelter.

Figure 7:
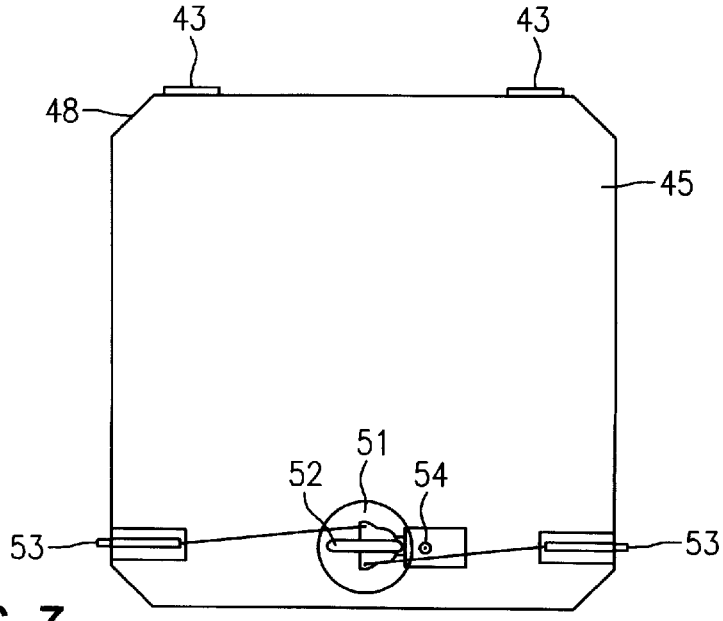
FIG. 7 is a top view of a latch mechanism.

Referring now to FIG. 7, the preferred dimensions of the hatch opening is 28 inches by 28 inches. The hatch corners 48 are beveled to permit construction by the vacuum molding process. The top hatch extension is formed with a draft angle of approximately five degrees to permit the top lid section 45 to be removed from the mold. This draft angle causes the hatch to be slightly smaller in dimension than the hatch opening, and a gasket is provided for sealing the hatch. After the vacuum forming process, a foam or wood backing is placed for reinforcement upon the acrylic before the fiberglass application. This reinforcement adds strength to the Hatch lid so that the lid will withstand a static or dynamic load. The reinforcement also provides a depth that permits the handle to be recessed. Similar reinforcement may be placed at other portions of the upper and lower section.

Figure 8A:
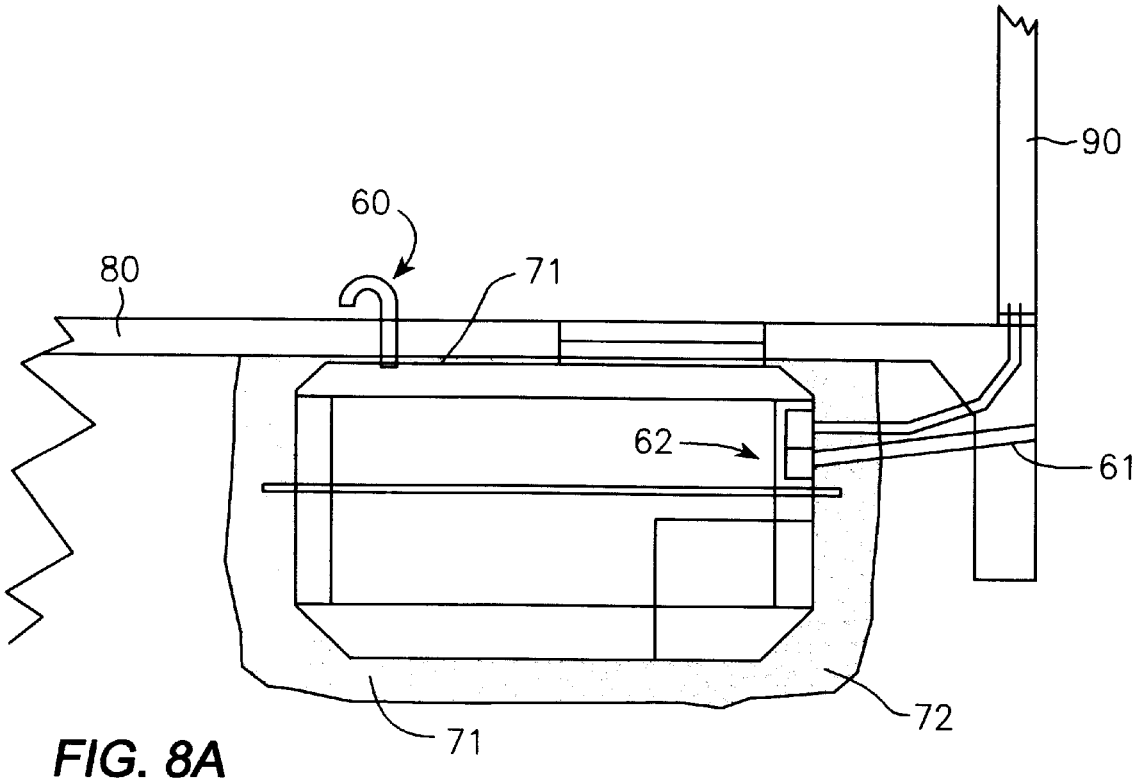
FIG. 8A is a side view of a slab installation.
Figure 8B:
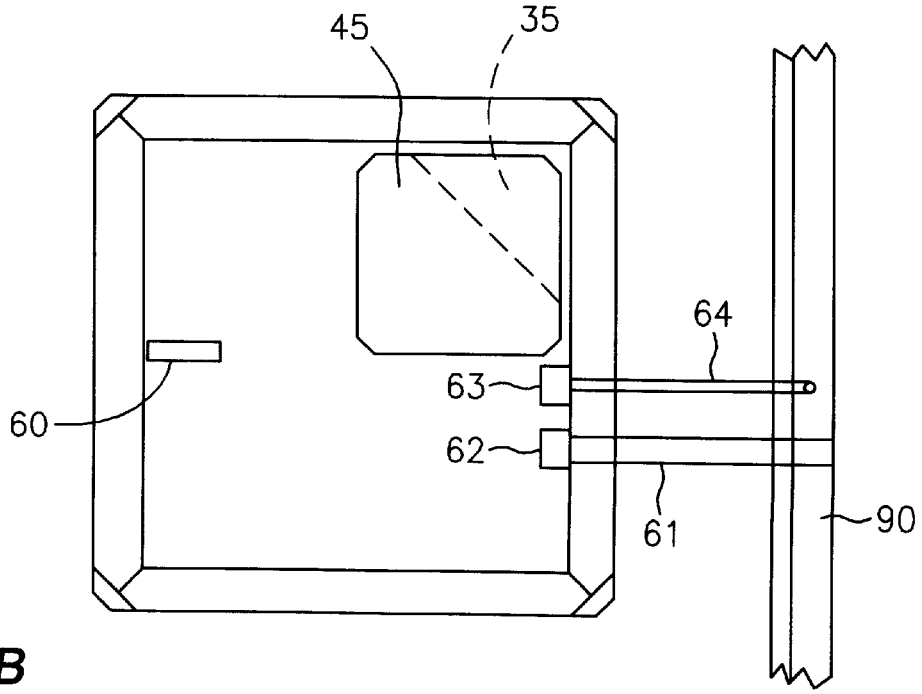
FIG. 8B is a top view of a slab installation.

The lid is typically placed under a cut away section of carpet with clear markings so that the occupants or residents can locate the shelter in a time of necessity. Referring now to FIGS. 8A and 8B, which are side and top views of the preferred installation, ventilation is provided through a vent pipe 60 and through an optional fan 62 which is vented through an external foundation wall 90. In some embodiments, a battery will be provided which will supply temporary power for ventilation and lighting. The preferred embodiment includes a conduit 64 to route lines to a junction box 63 which contains cable, electrical, and telephone outlets. It is desirable to place rechargeable flashlights and other electrical devices in the shelter, and to have a ground fault interrupt receptacle in the shelter. In the typical installation, conduit is supplied into the chamber so that wiring may be performed to support electricity for television, a telephone line, and a panic button type of signal device.

For the preferred shelter dimensions of 6' by 6' by 42" high, the foundation area is excavated to a depth of about 52" for an area approximately 7.5' square. The bottom of the excavation is then backfilled with about 5–6 inches of sand 71. The sides of the excavations are typically 1 to 2 feet wider than the main unit, and the sides are backfilled with a sand and gravel mix 72. Before the unit is place in the hole, the sand at the bottom of the pit is compacted and leveled. The grade is then taken to determine if sand should be added or removed to achieve the desired height and level of the bottom of the excavation pit. The grade will normally require at least 4 shots to determine consistency of the reading in order to verify that the bottom is level. Once the proper level and height have been obtained, the unit can be lowered into place. The preferred shelter dimensions result in a unit weight of about 300 to 350 pounds, and the unit can be positioned by 4 workmen without special equipment. After the unit is set, it is once again checked for level, and for the height of the hatch. Once the level is correct, the side fill is poured into place and compacted, and a layer of sand 71 up to ½" in thickness is placed on top of the unit. This top layer of sand permits the concrete slab to move freely. The slab is reinforced per standard design with reinforcement rods or cables.

Figure 4:
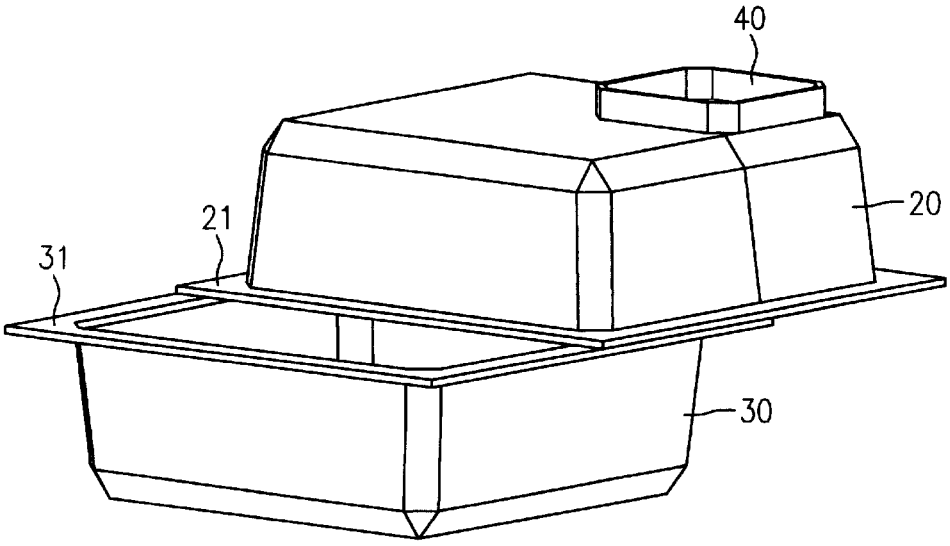
FIG. 4 is a perspective view with slight separation of the top and bottom shelter sections.

Referring now to FIG. 4, the preferred method of attaching the upper and lower sections is to bolt the sections together with stainless steel bolts and nuts at a spacing of approximately a spacing approximately 18 inches apart. At least one bead of silicon caulk is placed upon the lower section lip prior to assembly. The preferred assembly technique is to temporarily clamp the sections together while drilling at least one hole on each side of the unit. After the bolts are installed in each hole, then the temporary clamps may be removed, and the remaining holes may be drilled.

When used as a storm shelter, the occupants of a residence or other structure will move to the shelter hatch, open the lid by rotating the handle 90 degrees, and climb into the shelter. A step integral to the lower section of the shelter is used during ingress and egress. The occupants move away from the hatch area to permit additional persons to enter. Some shelters may be equipped with power ventilation and emergency power for monitoring radio or television for weather updates, and a telephone. After the last person has entered the shelter, the lid may be closed and secured by rotating the handle 90 degrees or pushing up on the lid until the spring loaded latches snap into place.

After danger has passed, the occupants open the lid by rotating the handle 90 degrees and exit the chamber.

The unit may be used as a storm shelter for tornado, hurricanes, and other severe weather; a security shelter; as an isolation chamber; as a storage compartment with relatively constant temperature; as an earthquake shelter; and as a mobile home type shelter.

ALTERNATE EMBODIMENT—PIER AND BEAM INSTALLATION

Figure 9A:
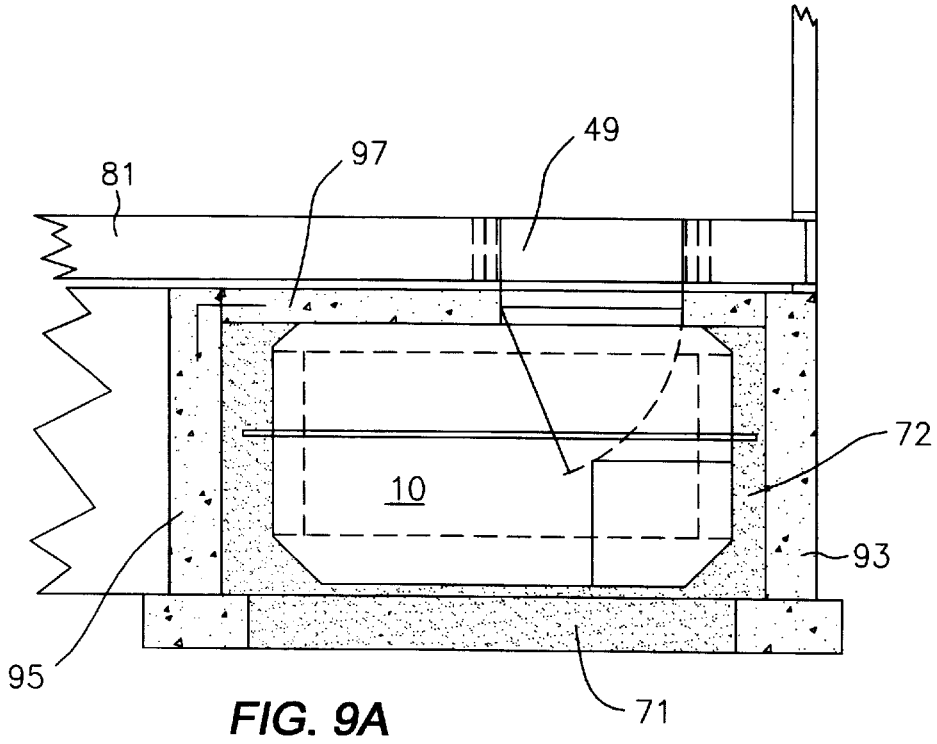
FIG. 9A is a side view of a pier and beam installation.
Figure 9B:
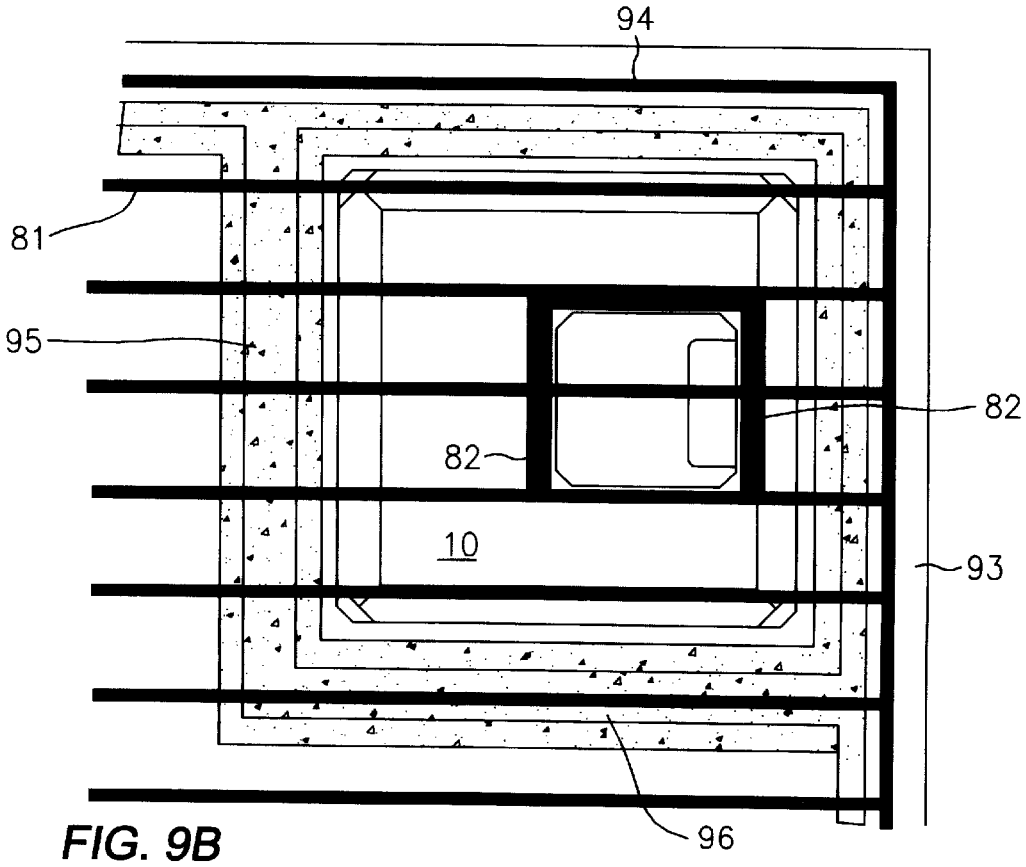
FIG. 9B is a top view of a pier and beam installation.

Referring now to FIGS. 9A and 9B, the preferred method of installation of the shelter in a pier and beam foundation is to prepare a location at a corner of the structure between two existing foundation walls 93 and 94, and to construct concrete retaining walls 95 and 96 in order to prepare an area approximately 1 foot wider and longer than the shelter unit. The bottom of the excavated area is filled with sand 71 and leveled as before, with the unit installed with a slight clearance between the top of the shelter and the bottom of the floor joists 81 or other support framing. Once the proper level has been achieved, the unit is then placed within the compartment and back filled with sand or sand and gravel along all sides of the shelter. A hatch extension 49 may be necessary to provide sufficient height to reach above the floor joists 81 to be approximately flush with the subfloor. Referring now to FIG. 9B, the floor joists are modified with headers 82 to provide an opening from shelter. It is still desirable to place the entry way in a location such as a interior closet in order to conceal the entrance. Once the unit is in place, a layer of sand up to ½" thick is placed on top of the unit, and a concrete cap 97 is poured. This cap provides protection against debris.

ALTERNATE EMBODIMENT—BASEMENT INSTALLATION

Figure 10A:
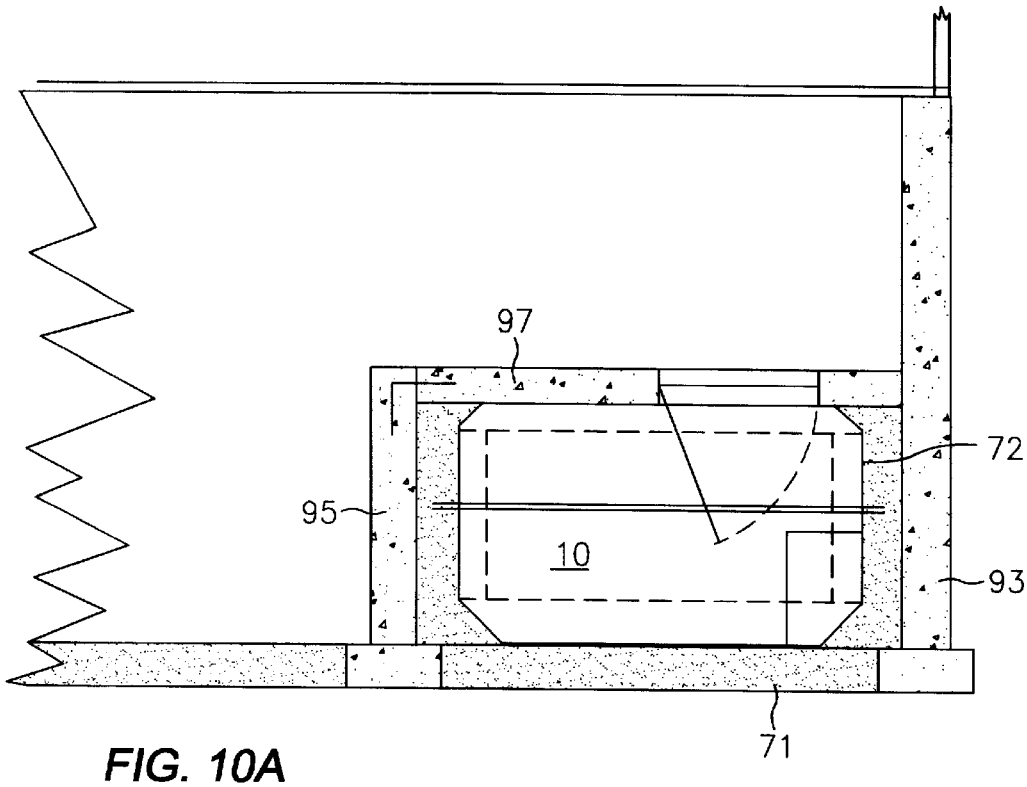
FIG. 10A is a side view of a basement installation.
Figure 10B:
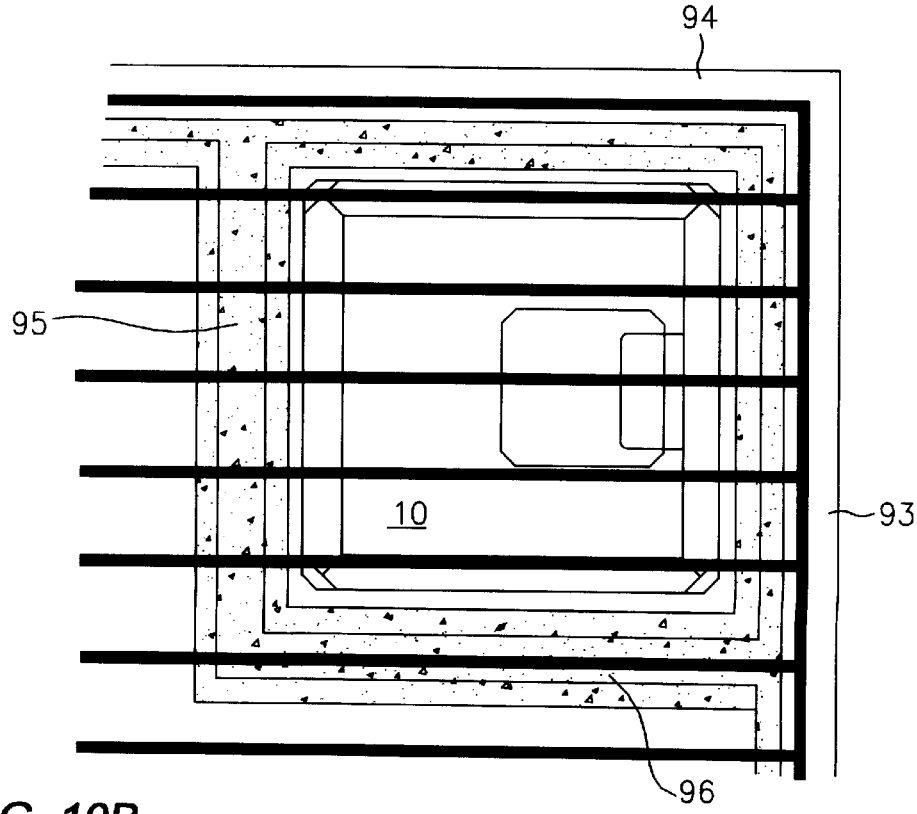
FIG. 10B is a top view of a basement installation.

Referring now to FIGS. 10A and 10B, the shelter may be installed in a basement. The preferred method of installing the shelter in a basement is to prepare a location at a corner of the structure between two existing foundation walls 93 and 94, and to construct concrete retaining walls 95 and 96 in order to prepare an area approximately 1 foot wider and longer than the shelter unit. The bottom of the excavated area is filled with sand 71 and leveled as before. Once the proper level has been achieved, the unit is then placed within the compartment and back filled with sand along all sides shelter. Once the unit is in place, a layer of sand up to ½" thick is placed on top of the unit, and a concrete cap 97 is poured. This cap provides protection against debris.

ALTERNATE EMBODIMENT—PATIO INSTALLATION

Figure 11A:
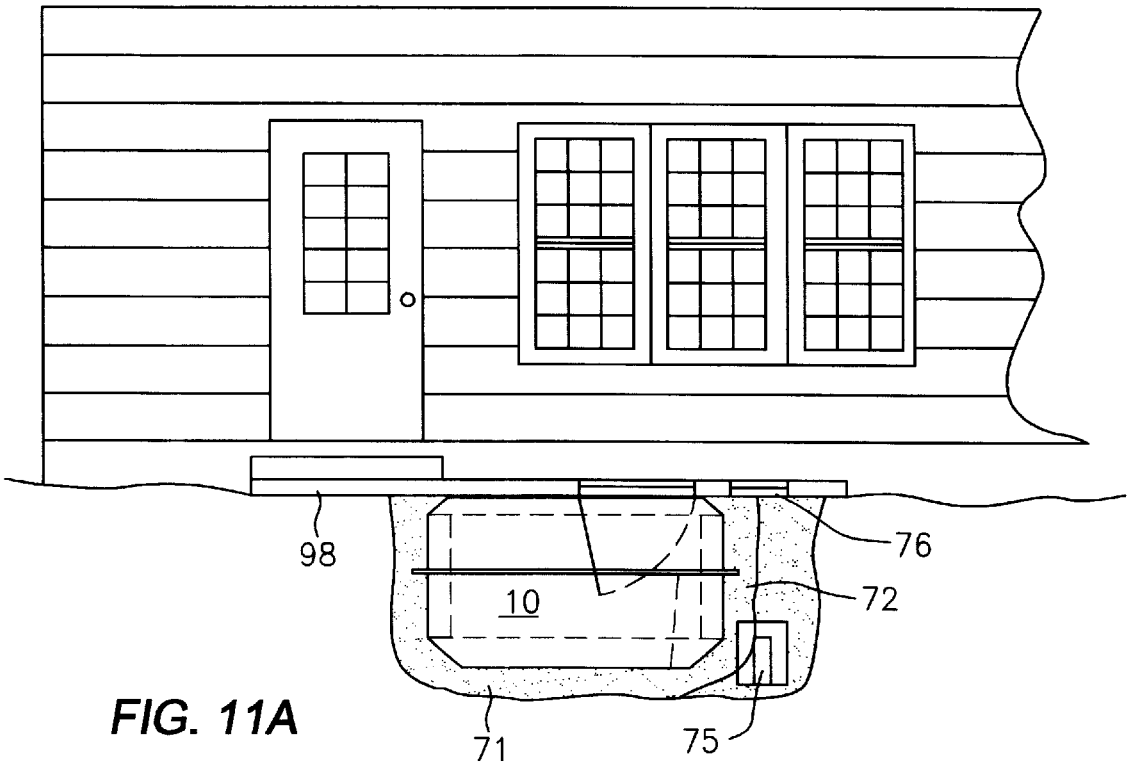
FIG. 11A is a side view of a patio installation.
Figure 11B:
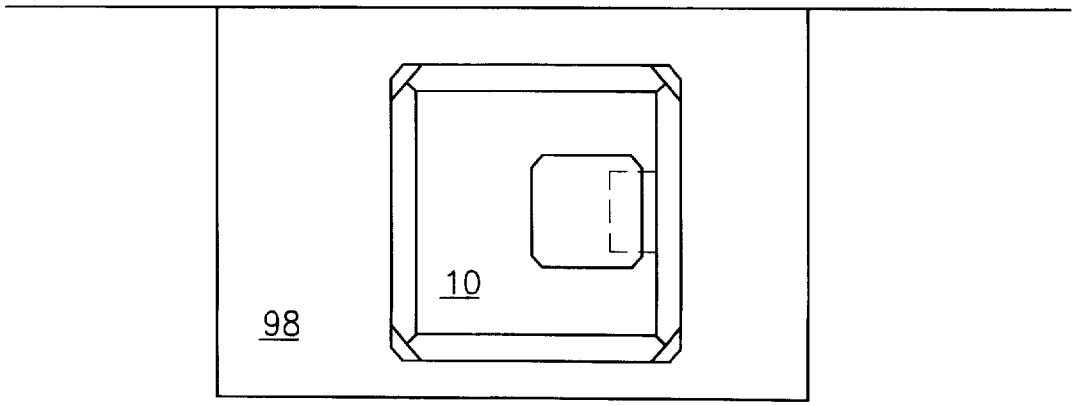
FIG. 11B is a top view of a patio installation.

Referring now to FIG. 11, the shelter may be installed under a patio or slab 98 at the exterior of the structure. The preferred method of installing the shelter under a patio is to prepare a location by excavating to a depth of about 52" for an area approximately 7.5' square. The bottom of the excavation is then backfilled with about 5–6 inches of sand 71. The sides of the excavations are typically 1 to 2 feet wider than the main unit, and the sides are backfilled with a sand and gravel mix 72. Before the unit is place in the hole, the sand at the bottom of the pit is compacted and leveled as described in the preferred embodiment. Once the level is correct, the unit is set in place and the side fill is poured into place and compacted, and a layer of sand 71 up to ½" in thickness is placed on top of the unit, and a concrete slab 98 is poured. The slab is reinforced per standard design with reinforcement rods or cables. A sump pump 75 may be provided. The sump pump is serviced through an access cover 76.

ALTERNATE EMBODIMENT—PARTIAL UNDERGROUND INSTALLATION

Figure 12A:
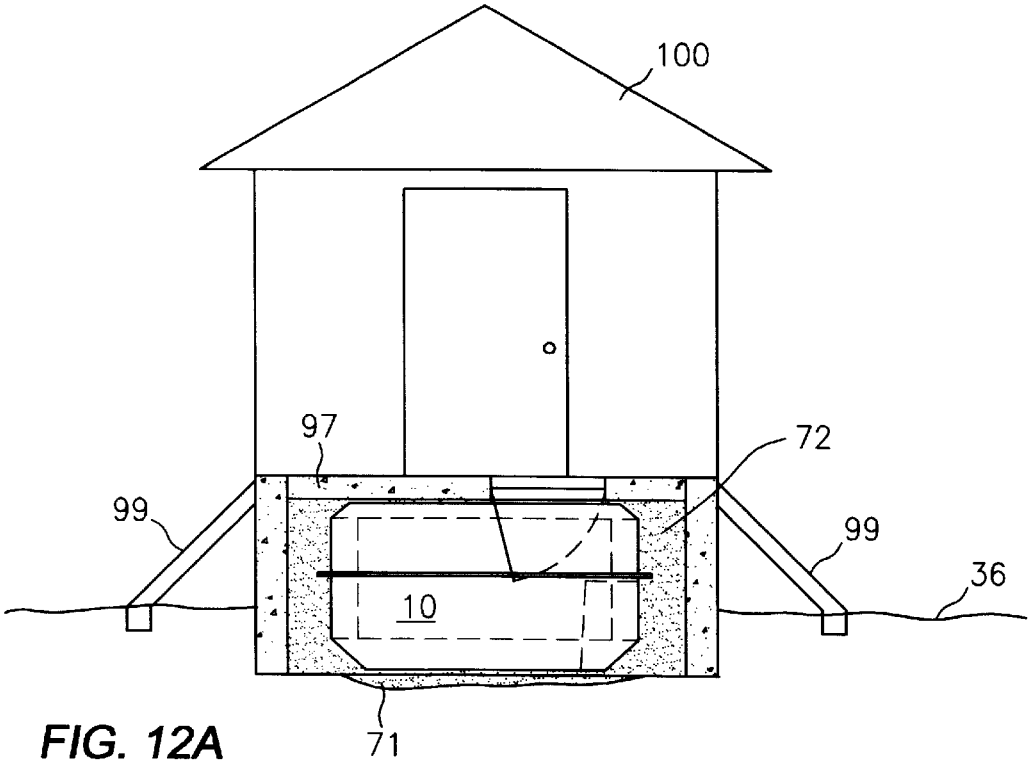
FIG. 12A is a side view of an exterior installation.
Figure 12B:
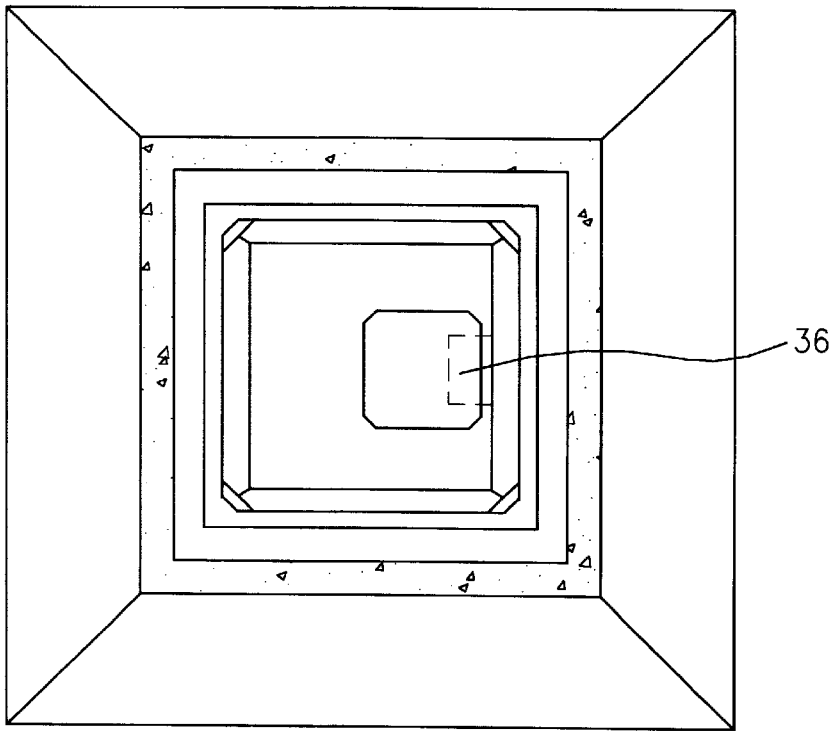
FIG. 12B is a top view of an exterior installation.

Referring now to FIG. 12, the shelter may be be installed under an exterior slab 97. The preferred method of installing a partial underground shelter is to prepare a location by excavating to a depth slightly less than the height of the bottom section of the shelter 10. The bottom of the excavation is then backfilled with about 5–6 inches of sand 71.

Retaining walls are preferably fabricated about 1 to 2 feet wider than the main unit, and the sides are backfilled with a sand and gravel mix 72. The retaining walls are supported by a concrete apron 99 which surrounds the retaining walls. The apron is preferably about 4" thick and makes an angle of about 45 degrees with respect to the retaining walls so that it can deflect high winds. Once the level is correct, the unit is set in place and the side fill is poured into place and compacted, and a layer of sand 71 up to ½" in thickness is placed on top of the unit, and a concrete slab 97 is poured. An optional storage shed 100 may be placed upon the slab. The partial underground installation provides protection for inhabitants of existing homes and structures. This embodiment is relatively inexpensive to build because less excavation is required than with traditional structures. The partial underground construction technique also minimizes many of the water table problems associated with traditional structures.

ALTERNATE EMBODIMENT—SITE ASSEMBLY

Although the preferred embodiment is to attach the top and bottom sections of the shelter at the point of manufacture, is also possible to ship the sections independently to the job site and to have a plumber or other skilled workman assemble unit on site. It is also possible to ship the sections to the distributor, and have the distributor make the final assembly top and bottom sections. The general advantage to pre-assembling the top and bottom section is to keep the shelter free of debris and to provide a water tight seal. In the case where the units are assembled at the job site or by a local distributor, the sections may be stacked for more efficient shipment.

ALTERNATE EMBODIMENT—FIBERGLASS JOINT

In an alternate embodiment, the upper and lower sections are assembled at the factory, and the fiberglass/resin mixture is applied to the joint.

ALTERNATE EMBODIMENT—SECURITY SHELTER

The unit may also serve as a temporary security shelter. In some installations, the presence of the unit may not be noticed by intruders to a home. Occupants may seek short periods of safety in the shelter by locking the door from the inside of the shelter. In some installations, a telephone will be available inside the shelter, and the phone can be used to call for assistance. A panic button may also be provided to permit an audible alarm to be activated from within the shelter.

ALTERNATE EMBODIMENT—STORAGE

The unit may also serve partially as a storage unit for occasionally used items or for items such as wine that may require a relatively constant, cool temperature.

ALTERNATE EMBODIMENT—VERTICAL EXTENSION

Referring now to FIG. 2B, in cases were additional head room is desired, one or more vertical extension sections 102 may be provided. Each extension will typically be about 18" high with a lip on the top and bottom which will mate with the lips on the upper and lower sections.

What is claimed is:

1. A method of installing a low excavation volume emergency storm shelter beneath a concrete slab foundation comprising the steps of:

providing a fiberglass reinforced shelter upper section having a generally rectangular cross section approximately 6 feet wide and 6 feet long, the upper section containing a tapered riser section over a portion of the upper section;

and a door positioned in the riser section, such that the door can open only in one direction;

providing a fiberglass reinforced shelter lower section having a generally rectangular cross section approximately 6 feet wide and 6 feet long;

assembling the upper section and the lower section, such that the assembled shelter has a height of approximately 42 inches without the riser section;

excavating an area approximately 7.5 feet wide and 7.5 feet long within a slab foundation to a depth of approximately 52 inches prior to pouring the slab;

placing and leveling approximately 5 inches of fill material in the bottom of the excavated area;

placing the assembled section in the excavated area on top of the fill material; backfilling with a fill material between the shelter sides and the excavation sides; and pouring the slab foundation such that a floor opening is left around the riser section.

2. The method of claim 1 comprising the additional step of assembling the upper section and the lower section at a job site.

3. The method of claim 1 comprising the additional step of assembling the upper section and the lower section before shipment to a job site.

4. The method of claim 1 comprising the additional steps of installing the shelter beneath a concrete patio.

5. A method of installing a low excavation volume emergency storm shelter beneath a pier and beam foundation floor comprising the steps of:

providing a fiberglass reinforced shelter upper section having a generally rectangular cross section approximately 6 feet wide and 6 feet long, the upper section containing a tapered riser section over a portion of the upper section;

and a door positioned in the riser section, such that the door can open only in one direction;

providing a fiberglass reinforced shelter lower section having a generally rectangular cross section approximately 6 feet wide and 6 feet long;

assembling the upper section and the lower section, such that the assembled shelter has a height of approximately 42 inches without the riser section;

forming a containment area slightly larger than the shelter;

placing the assembled section within the containment area; and building the pier and beam foundation, such that there is a floor opening above the riser section.

6. The method of claim 5 comprising the additional step of forming the containment area with one or more foundation wall and one or more additional containment wall.

7. A method of installing a low excavation volume emergency storm shelter beneath a exterior patio comprising the steps of:

providing a fiberglass reinforced shelter upper section having a generally rectangular cross section approximately 6 feet wide and 6 feet long, the upper section containing a tapered riser section over a portion of the upper section;

and a door positioned in the riser section, such that the door can open only in one direction;

providing a fiberglass reinforced shelter lower section having a generally rectangular cross section approximately 6 feet wide and 6 feet long;

assembling the upper section and the lower section, such that the assembled shelter has a height of approximately 42 inches without the riser section;

forming a containment area slightly larger than the shelter;

placing the assembled section within the containment area; and fabricating a patio above the shelter.

8. A method of installing a low excavation volume emergency storm shelter partially in-ground comprising the steps of:

providing a fiberglass reinforced shelter upper section having a generally rectangular cross section approximately 6 feet wide and 6 feet long, the upper section containing a tapered riser portion over a portion of the upper section;

and a door positioned in the riser section, such that the door can open only in one direction;

providing a fiberglass reinforced shelter lower section having a generally rectangular cross section approximately 6 feet wide and 6 feet long;

assembling the upper section and the lower section, such that the assembled shelter has a height of approximately 42 inches without the riser portion;

forming a containment area slightly larger than the shelter by fabricating retaining walls around the shelter;

placing the assembled section within the containment area such that the upper section is approximately above grade; and fabricating a concrete slab above the shelter.

* * * * *